US010711999B2

(12) United States Patent
Baronnet et al.

(10) Patent No.: US 10,711,999 B2
(45) Date of Patent: Jul. 14, 2020

(54) ARRANGEMENT FOR THE OUTLET NOZZLE OF A SUBMERGED PLASMA TORCH DEDICATED TO WASTE TREATMENT

(71) Applicant: COMMISSARIAT A L'ENERGIE ATOMIQUE ET AUX ENERGIES ALTERNATIVES, Paris (FR)

(72) Inventors: Jean-Marie Baronnet, Limoges (FR); Florent Lemont, Villeneuve Les Avignon (FR); Majdi Mabrouk, Bagnols sur Ceze (FR); Mickael Marchand, Sabran (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 721 days.

(21) Appl. No.: 15/306,670

(22) PCT Filed: Apr. 28, 2015

(86) PCT No.: PCT/EP2015/059226
§ 371 (c)(1),
(2) Date: Oct. 25, 2016

(87) PCT Pub. No.: WO2015/165911
PCT Pub. Date: Nov. 5, 2015

(65) Prior Publication Data

US 2017/0059156 A1 Mar. 2, 2017

(30) Foreign Application Priority Data

Apr. 30, 2014 (FR) ..... 14 53977

(51) Int. Cl.
*B23K 10/00* (2006.01)
*F23G 5/08* (2006.01)

(52) U.S. Cl.
CPC ..... *F23G 5/085* (2013.01); *F23G 2204/201* (2013.01)

(58) Field of Classification Search
CPC .... F23G 5/085; G23G 2204/201; H05H 1/34; H05H 1/28; H05H 1/48; B23K 10/006; B23K 10/00
(Continued)

(56) References Cited

U.S. PATENT DOCUMENTS 4,644,877 A 2/1987 Barton et al.
5,443,572 A * 8/1995 Wilkinson ..... C21C 5/35 110/235
(Continued)

FOREIGN PATENT DOCUMENTS

EP 0 469 737 A2 2/1992
FR 2 558 571 A1 7/1985
(Continued)

OTHER PUBLICATIONS

N.V. Alekseev, et al., "Thermal-Plasma Jet Oxidation of Phenol in Aqueous Solutions," High Energy Chemistry, vol. 34, No. 6, 2000, pp. 389-393.
(Continued)

*Primary Examiner* — Mark H Paschall
(74) *Attorney, Agent, or Firm* — Oblon, McClelland, Maier & Neustadt, L.L.P.

(57) ABSTRACT

An injection and cooling system configured to equip a plasma torch, a plasma torch equipped with the system, an installation for treatment of a liquid solution including such a plasma torch, and a method for treatment of a liquid solution by injection into a plasma generated by such a plasma torch submerged in a different liquid solution.

13 Claims, 4 Drawing Sheets

(58) Field of Classification Search
USPC ..... 219/121.36, 121.49, 121.48, 121.52, 219/121.51, 121.55; 373/18–22
See application file for complete search history.

(56) References Cited

U.S. PATENT DOCUMENTS

| | | | | |
|---|---|---|---|---|
| 6,187,206 | B1 * | 2/2001 | Bernier | B01J 19/088 159/47.3 |
| 6,372,156 | B1 * | 4/2002 | Kong | B01J 12/002 252/373 |
| 2013/0126445 | A1 | 5/2013 | Lemont et al. | |

FOREIGN PATENT DOCUMENTS

| | | | |
|---|---|---|---|
| WO | 97/22556 | A1 | 6/1997 |
| WO | 2011/064361 | A1 | 6/2011 |
| WO | 2014/046593 | A1 | 3/2014 |

OTHER PUBLICATIONS

L. Fortin, et al., "The Use of Thermal Plasma for Wastewater Treatment," 14$^{th}$ International Symposium on Plasma Chemistry—ISPC'14, pp. 2387-2392.
International Search Report dated Jun. 26, 2015 in PCT/EP2015/059226 filed Apr. 28, 2015.
French Search Report dated Dec. 17, 2014 in FR 1453977 filed Apr. 30, 2014.

* cited by examiner

FIG.3A
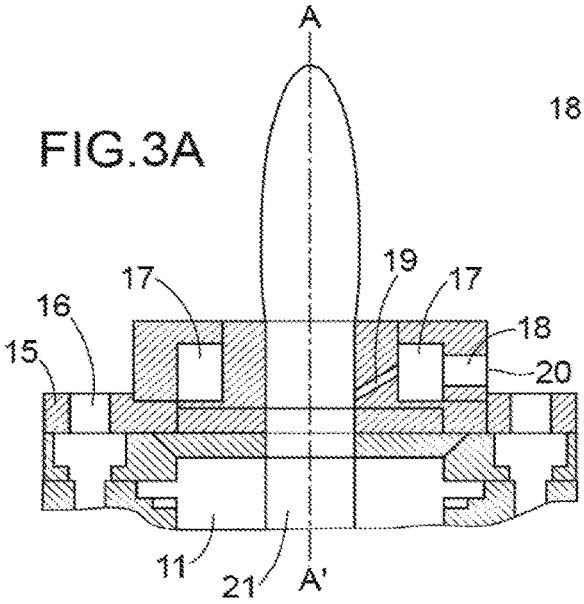
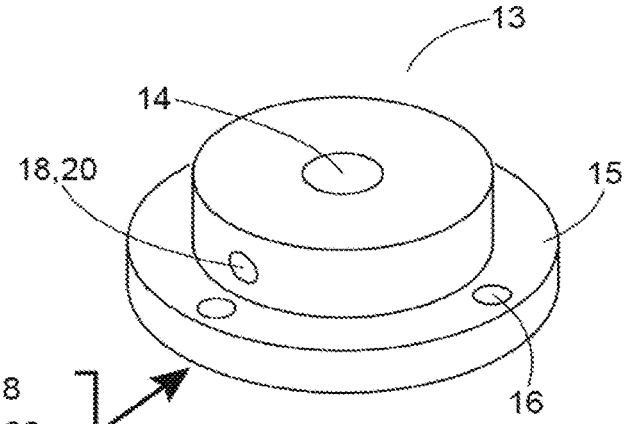
FIG.3B
FIG.4A
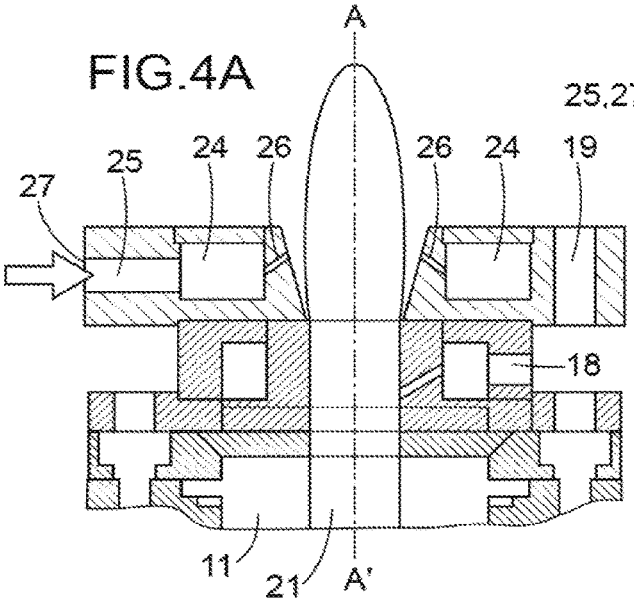
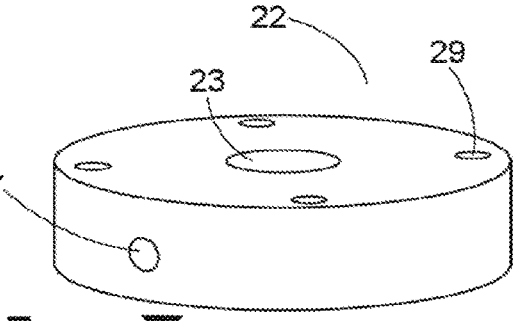
FIG.4B 37
35
A 39
40
38
38

39
40
A'

ARRANGEMENT FOR THE OUTLET NOZZLE OF A SUBMERGED PLASMA TORCH DEDICATED TO WASTE TREATMENT

FIELD OF THE INVENTION

The present invention relates to the field of the treatment of waste such as advantageously liquid chemical waste.

More particularly, the present invention relates to the arrangement of the outlet nozzle of a submerged plasma torch by installing a liquid injection system and adding an adapted combustion gas cooling system. As such, the present invention proposes an injection and cooling system intended to equip a plasma torch, the plasma torch equipped in this way as well as an installation and a method for the treatment of a liquid solution comprising or using such a plasma torch.

STATE OF THE RELATED ART

The treatment of liquid waste of all kinds such as organic, hazardous and/or radioactive waste is currently performed by means of thermal methods involving furnace type reactors which may be of different types such as static furnaces or rotary furnaces, heated by various means.

As such, the waste treatment methods implement thermal units connected to relatively substantial gas treatment systems to carry out the cooling, filtration and neutralisation of certain elements such as chlorine. This generally results in large-sized units subject to high temperatures. The presence of certain elements such as chlorine, phosphorus, sulphur, etc. subject to these high temperatures exacerbates the corrosive properties of the gases, which forces manufacturers either to choose superalloys which are often very costly, or to accept frequent replacement of certain parts of the method.

The reactors involved may be of different types. They may consist of furnaces heated by the Joule effect, by plasma torches or by the combustion of gas fuels such as propane. The temperature of the treatment can thus vary according to the nature of the load. If, for example, it consists of dodecane type hydrocarbons, this load may develop a thermal power of approximately 10 kW per l/h, which needs to be discharged. If, on the other hand, it consists of an aqueous solution, the power of the plasma will be partially used for the evaporation thereof. The temperature behaviour of the reactor involved in the method is thus substantially impacted by the nature of the liquid to be treated.

According to the method, the introduction of the liquids may vary. Either they are introduced into the heart of the hot spot of the furnace, or they are introduced into the power source. For example, they can be evaporated in the fuel gas or introduced directly into a plasma. They can be treated alone or in a mixture with solids according to the circumstances. By way of example, the patent application EP 0,469,737 proposes a method and a device for the treatment of liquids in an air plasma [1]. In this example, the plasma burns in a refractory reactor and the liquids are introduced into the gas stream generating the plasma. Such a method requires a relatively cumbersome device as the gases produced must be treated via scrubbing columns in particular.

Furthermore, regardless of the method used, it would appear that the nature of the liquids can vary substantially for heat emission reasons but also for reasons of compatibility with the materials chosen to produce the reactor.

A number of solutions to the problem of waste treatment involving the use of submerged plasmas have previously been proposed. For example, mention may be made of the publication by N. V. Alekseev et al reporting a treatment method wherein a plasma flows into a receptacle containing an aqueous solution polluted with a few tens of mg of phenol per litre of water [2]. In this case, the plasma serves to produce hydrogen dioxide which oxidises the dissolved organic compounds. The publication by G. Fortin et al also mentions a method involving an argon/nitrogen plasma torch, burning at the bottom of a reactor filled with cyanide-charged leachates [3]. An international application has further been filed by the same authors to protect the invention [4].

In any case, these methods have been developed to treat aqueous solutions containing small quantities of substances to be removed: a few ppm of phenol in the first case, a few ppm of cyanides in the second. The substances are degraded progressively by the plasma torch operating at the core of the solution, said torch producing the chemical radicals required for the oxidation of the organic compounds.

Recently, the international application WO 2011/064361 proposed a method for the treatment of chemical waste, particularly liquid waste, enhanced in terms of speed and efficiency, suitable for the treatment of liquids, regardless of the nature and/or composition thereof, using a device which is simpler, more compact and less costly in the production and/or use thereof [5]. The principle of the method described in this international application is based on a blown arc plasma torch wherein a liquid to be treated is introduced. This plasma torch such that an oxygen plasma, positioned at the bottom of a reactor filled with a solution different to the liquid to be treated and particularly filled with water carries out the combustion of the organic compounds introduced therein; it produces gases which are directly quenched and scrubbed.

This technique offers various advantages which are: (i) the very rapid quenching of the gases preventing the formation of undesirable compounds such as dioxins or furans; (ii) the direct handling of potentially corrosive elements such as, for example, chlorine, fluorine and phosphorus, by neutralisation in the solution different to the liquid to be treated and particularly in water; (iii) direct prefiltration of the gases by bubbling through a certain height of water; and (iv) the system remaining generally cold which enables it to be readily protected from corrosion risks.

As such, the method described in the international application WO 2011/064361 makes it possible to carry out rapid degradation of organic liquids with destruction efficiencies close to 99.98% during the treatment of 1 L/h of phosphorus-containing hydrocarbon.

Furthermore, the international application WO 2011/064361 describes a part placed at the end of the plasma torch forming an additional combustion zone and suitable for having two different types of channels, one suitable for conveying oxidant gas and the others for introducing the solution to be treated into the core of the plasma.

Research has been conducted in order to extend the operating range and increase the treatment rate which has made it possible to achieve good degradation yields with however combustion gases wherein the quality can be very variable according to the products treated. In some cases, the CO content in the gases can be close to 10% which requires, in the light of emission standards, either the installation of a post-combustion chamber at the reactor outlet, or the exclusion of certain liquids from the treatment range.

The inventors thus set themselves the aim of enhancing the method described in the international application WO 2011/064361 further so as particularly to increase the quality of the gases released while increasing the organic compound destruction efficiency further.

In other words, the inventors set themselves the aim to propose a technological enhancement conducted with a view to optimising the nature and the composition of the gases before they are quenched in the reactor solution, such as water, in the core of which the treatment plasma is submerged.

DESCRIPTION OF THE INVENTION

The aims set and others are achieved by the invention which proposes substantially modifying the outlet geometry of the submerged torch and, more particularly, adding at the plasma torch outlet a plurality of stages in order to ensure optimal destruction of the organic matter accompanied by fully oxidised combustion gas production.

FIG. 1 recalls in the right part thereof the concept of the method described in the international application WO 2011/064361 and provides in the left-hand insert a view of the parts added at the plasma torch outlet and which represent the very focal point of the invention.

This assembly successively comprising an injection device, an oxidising dilution device, a reinjection device and a cooling device makes it possible to ensure full and rapid oxidation of the gases from the method and obtain compositions for these gases in accordance with the various emission standards. As such, the present invention relates to an injection and cooling system, intended to equip a plasma torch, having a cavity intended to contain plasma and combustion gas and comprising:

- a first injection device devised to (intended to) inject, into said cavity, a liquid solution to be treated hereinafter referred to as solution $S_1$,
- a second injection device arranged against said first injection device and devised to (intended to) inject, into said cavity, an oxidant gas,
- a cooling device devised to (intended to) cool the gas(es) contained in said cavity, said system comprising a third injection device inserted between said second injection device and said cooling device and devised to (intended to) inject, into said cavity, a liquid solution different to the liquid solution to be treated hereinafter referred to as solution $S_3$ and said four devices being hollow, coaxially aligned and defining said cavity.

In other words, the enhancement according to the present invention is based on the arrangement of the nozzle outlet of the plasma torch which has been equipped with 4 technological elements placed on top of one another and which are:

- a first device or stage for injecting the liquid to be treated devised to convey same as close as possible to the plasma flame: introducing the liquid to be treated and particularly organic liquids as close as possible to the plasma ensures volatilisation and rapid pre-oxidation of the chemical compounds present in this liquid;
- a second device or stage for injecting oxidant gas enabling re-enrichment with oxygen which guarantees stoichiometric conditions and enhances the oxidation of the chemical compounds and the combustion of the treatment gases;
- a third device or stage for injecting liquid other than the solution to be treated guaranteeing rapid cooling of the gases to a temperature level required for an equilibrium shift in favour of superior oxidation of the gases and thus favourable for emission standards; and
- the final device or stage for cooling at the end of the reaction providing a sufficient dwell time for the gases so as to enable the finalisation of the reactions and achieve the chemical equilibriums sought which makes it possible to optimise combustion before quenching the gases in the reactor solution.

Within the scope of the treatment of liquid waste, the advantages offered by the injection and cooling system according to the present invention essentially relate to the organic compound destruction efficiency and the gas emission quality. Furthermore, besides the advantages associated with the enhancement provided by the injection and cooling system according to the invention, those intrinsic to the method described in the international application WO 2011/064361 are also found, i.e. the destruction of a solution to be treated injected into the core of a plasma burning in a solution different to the solution to be treated and particularly in water, quasi-instantaneous quenching of the gases in water, quasi-instantaneous condensation of volatile substances, dust extraction from the gases by means of a scrubbing effect and neutralisation of the gases during bubbling.

The first injection device of the system according to the invention, devised to (intended to) introduce, into said cavity, the solution $S_1$ to be treated comprises at least one first channel leading to said cavity and devised to (intended to) convey said solution $S_1$ therein. This device may comprise at least two first channels, at least three first channels, or at least four channels leading to said cavity and devised to (intended to) convey said solution $S_1$ therein.

The first channel(s) may have any orientation. They may be oriented towards the plasma outlet orifice, towards the second injection device or perpendicularly to the plasma torch axis. The first channels may all have the same orientation or at least two different orientations. However, as an advantageous alternatively, the first channel(s) are all oriented towards the plasma outlet orifice.

This first device is advantageously made of a material suitable for the solution $S_1$ to be treated. Such a material is typically a metal such as copper or an alloy, particularly a non-oxidising alloy such as stainless steel or an alloy based on nickel and chromium and comprising at least one element chosen in the group consisting of iron, molybdenum, manganese, niobium and copper, particular examples of such alloys being marketed under the brand Inconel. Such a material may also be a ceramic. Furthermore, this first device may have internal water circulation cooling means.

The second injection device of the system according to the invention, devised to (intended to) introduce, into said cavity, an oxidant gas comprises at least one second channel leading to said cavity and devised to (intended to) convey said oxidant gas therein. This device may comprise at least two second channels, at least three second channels, or at least four second channels leading to said cavity and devised to (intended to) convey said oxidant gas therein.

The second channel(s) may have any orientation. They may be oriented towards the first injection device, towards the third injection device or perpendicularly to the plasma torch axis. The second channels may all have the same orientation or at least two different orientations. However, as an advantageous alternative, the second channel(s) are all oriented towards the third injection device.

This second injection device is advantageously made of a material suitable for the solution $S_1$ to the treated. Such a material is typically a metal such as copper or an alloy, particularly a non-oxidising alloy such as stainless steel or an alloy based on nickel and chromium and comprising at least one element chosen in the group consisting of iron, molybdenum, manganese, niobium and copper, particular examples of such alloys being marketed under the brand Inconel. Furthermore, this second device may have internal water circulation cooling means.

The third injection device of the system according to the invention, devised to (intended to) introduce, into said cavity, a liquid solution different to the liquid solution to be treated hereinafter referred to as solution $S_3$ comprises at least one third channel leading to said cavity and devised to (intended to) convey said solution $S_3$ therein. This device may comprise at least two third channels, at least three third channels, or at least four third channels leading to said cavity and devised to (intended to) convey said solution $S_3$ therein.

The third channel(s) may have any orientation. They may be oriented towards the second injection device, towards the cooling device or perpendicularly to the plasma torch axis. The third channels may all have the same orientation or at least two different orientations. However, as an advantageous alternative, the third channel(s) are all oriented perpendicularly to the plasma torch axis.

This third injection device is advantageously made of a material suitable for the solution $S_1$ to be treated. Such a material is typically a metal such as copper or an alloy, particularly a non-oxidising alloy such as stainless steel or an alloy based on nickel and chromium and comprising at least one element chosen in the group consisting of iron, molybdenum, manganese, niobium and copper, particular examples of such alloys being marketed under the brand Inconel. Furthermore, this third device may have internal water circulation cooling means.

The cooling device of the system according to the present invention devised to (or intended to) cool the gas(es) contained in said cavity have a sufficient length to ensure complete and optimal oxidation of the organic load present in the solution to be treated. Advantageously, said cooling device comprises at least one sheath cooled by internal water circulation.

Furthermore, this cooling device is advantageously made of a material suitable for the solution $S_1$ to be treated. Such a material is typically a metal such as copper or an alloy, particularly a non-oxidising alloy such as stainless steel or an alloy based on nickel and chromium and comprising at least one element chosen in the group consisting of iron, molybdenum, manganese, niobium and copper, particular examples of such alloys being marketed under the brand Inconel.

In the injection and cooling system according to the present invention, at least one injection device chosen in the group consisting of the first injection device, the second injection device and the third injection device comprises internal water circulation cooling means. In one particular embodiment, at least two of these devices comprise internal water circulation cooling means. As such, the first and second injection devices, the first and third injection devices or the second and third injection devices comprise internal water circulation cooling means. In one even more particular embodiment, the first, second and third injection devices comprise internal water circulation cooling means.

The present invention also relates to a plasma torch equipped with an injection and cooling system as defined above. Any plasma torch, particularly any arc plasma torch and, in particular, any blown arc plasma torch is suitable for use within the scope of the present invention. The power and intensity of the plasma torch according to the present invention will be chosen according to the solution $S_1$ to be treated and according to the flow rate to be injected.

The present invention further relates to an installation for the treatment of a liquid solution $S_1$ comprising:

- a plasma torch equipped with an injection and cooling system as defined above;
- a container of liquid solution $S_1$;
- first means devised to convey the liquid solution $S_1$ from said container of liquid solution $S_1$ to the first injection device of said injection and cooling system;
- a container of oxidant gas;
- second means devised to convey the oxidant gas from said container of oxidant gas to the second injection device of said injection and cooling system;
- a container of liquid solution $S_3$; and
- third means devised to convey the liquid solution $S_3$ from said container of liquid solution $S_3$ to the third injection device of said injection and cooling system.

In the treatment installation according to the invention, the container of liquid solution $S_1$ may be of any shape and volume. It may be made of a material suitable for the nature of the liquid solution $S_1$. For example, such a material may be a metal, a ceramic or an alloy, particularly a non-oxidising alloy such as stainless steel.

The solution $S_1$ used within the scope of the present invention may be any liquid solution, advantageously organic, liable to contain at least one organic, toxic, harmful, corrosive and/or radioactive compound. The term "organic, toxic, harmful, corrosive and/or radioactive compound" denotes at least one element chosen from the heavy metals; radioactive elements and organic elements. By way of non-limiting examples, these compounds are chosen from the group consisting of chlorine, fluorine, sulphur, zinc, phosphorus, mercury, lead, cadmium, arsenic, phenol, cyanides, ferrocyanides, oxalates, humic acids, strontium, ruthenium, caesium, a emitters, such as americium, plutonium and uranium and mixtures thereof. The solution $S_1$ may be presented in the form of an organic liquid, pure or in a mixture, a radioactive liquid, an emulsion, a microemulsion, an aqueous solution, a suspension of particularly organic compounds in an aqueous solution, a liquid containing particles obtained from pulverising a solid or a hazardous liquid waste.

More particular, by the solution $S_1$ may be any type of solution containing organic matter optionally bound with minerals. Such a solution may be obtained from any civilian applications, nuclear or not, or any military applications, nuclear or not. By way of non-limiting examples, the solution $S_1$ may be chosen from the group consisting of a solution obtained from sewerage plants or sewerage plant sludge, wastewater, used oils, household liquid waste, medical or hospital liquid waste, industrial liquid waste and liquid waste from nuclear installations. In the present invention, the expressions "solution $S_1$", "liquid solution $S_1$", "liquid to be treated" or "solution to be treated" are equivalent and can be used interchangeably.

In the treatment installation according to the invention, the container of oxidant gas may be of any shape and volume. The oxidant gas may be chosen from the group consisting of oxygen, air, carbon dioxide and mixtures thereof. The oxidant gas is advantageously oxygen. The container of oxidant gas may be a cylinder of oxidant gas and particularly of pressurised oxygen.

In the treatment installation according to the invention, the container of liquid solution $S_3$ may be of any shape and volume. It may be made of a material suitable for the nature of the liquid solution $S_3$. For example, such a material may be a metal, a plastic, a ceramic or an alloy, particularly a non-oxidising alloy such as stainless steel.

In a first embodiment, the container of liquid solution $S_3$ is a reactor containing a solution $S_2$ different to the liquid solution $S_1$ to be treated. In the treatment method according to the present invention described hereinafter, the plasma is submerged in this reactor and thereof in this solution $S_2$. This embodiment enables a second passage in the plasma core of any organic compounds still present in the reactor solution and as such makes it possible to increase the organic compound destruction rate further.

As explained in the international application WO 2011/064361, the solution $S_2$ wherein the plasma is submerged carries out the cooling of the reactor without necessarily requiring additional elements for cooling the walls of the reactor. This solution $S_2$ also has a role in the treatment of gas emissions since it performs the quenching, dust extraction and neutralisation of the gases produced and the condensation of the volatile substances produced. The solution $S_2$ thus acts as a cooler, filter and scrubbing column.

The solution $S_2$ is an aqueous or saline solution and advantageously water. The solution $S_2$ may further contain at least one additive ensuring the destruction of residual organic matter. Such an additive is a catalyst ensuring advanced degradation of residual organic matter. These catalysts may, for example, activate Fenton reactions activated by the plasma radiation. They may consist of Fenton reagents ensuring radical production in plasma radiation. One particular example of such catalysts consists of metal ions and particularly ferrous ions enabling the production of extremely oxidant .OH radicals, the ferric ions produced being regenerated into ferrous ions by UV radiation. The use of a Fenton type reaction inside the reactor using UV radiation from the plasma torch or a further device offers the advantage of providing a means to destroy residual organic matter, this type of reaction being suitable for the treatment of organic substances in very small quantities typically of the order of one ppm.

Furthermore, the pH of the solution $S_2$ may be maintained at a value close to neutrality. In the present invention, the expressions "solution $S_2$", "liquid solution $S_2$" and "reactor solution" are equivalent and can be used interchangeably.

The solution $S_2$ is not only different from solution $S_1$ but also does not correspond to a liquid solution from the treatment of particularly liquid waste such as a solution $S_1$ or resulting from such a treatment, such as, for example a solution containing partially treated waste liable to be obtained from a prior treatment of liquid waste, a molten bath obtained from the treatment of waste, a metal layer of such a molten bath or a layer of slag of such a molten bath. The definition of the solution $S_2$ above obviously includes when the latter is used i.e. when the plasma is submerged therein and prior to the injection of the solution $S_1$.

In a further embodiment, the container of liquid solution $S_3$ and the reactor containing a solution $S_2$ different to the liquid solution $S_1$ as defined above are two different elements. In other words, the treatment installation according to the present invention further has a reactor containing a solution $S_2$ different to the liquid solution $S_1$ and as defined above. In this embodiment, the liquid solution $S_3$ contained in the container of solution $S_3$ is typically an aqueous or saline solution and advantageously water.

Regardless of the embodiment, the reactor of the installation according to the invention may be of any shape and volume. As described in the international application WO 2011/064361, the solution $S_2$ carries out the cooling of the reactor, the latter thus does not necessarily need to be made of a material suitable for withstanding very high temperatures as it is cold. Advantageously, it is made of stainless steel.

The first means devised to convey the liquid solution $S_1$ from said container of liquid solution $S_1$ to the first injection device of said injection and cooling system may be any means suitable for conveying a liquid from one compartment to a different compartment. Of these means, mention may be made of liquid supply pumps and hydrostatic pressure liquid supply pumps. These means are fluidically connected to the container of liquid solution $S_1$ and/or to the first injection device of said injection and cooling device by piping made of flexible material or rigid material.

The second means devised to convey the oxidant gas from said container of oxidant gas to the second injection device of said injection and cooling system may be any means suitable for conveying a gaseous fluid from one compartment to a different compartment, such as, for example, gas supply pumps and relief valves. These means are fluidically connected to the container of oxidant gas and/or to the second injection device of said injection and cooling system by piping made of flexible material or rigid material.

The third means devised to convey the liquid solution $S_3$ from said container of liquid solution $S_3$ to the third injection device of said injection and cooling system may be any means suitable for conveying a liquid fluid from one compartment to a different compartment. Of these means, mention may be made of liquid supply pumps and hydrostatic pressure liquid supply pumps. These means are fluidically connected to the container of liquid solution $S_3$ and/or to the third injection device of said injection and cooling device by piping made of flexible material or rigid material.

The treatment installation according to the present invention may further comprise a device generating ultraviolet radiation. It is clear that this device is different from the plasma torch present in said installation. Any UV radiation system i.e. any system capable of emitting radiation wherein the wavelength range is in the near-ultraviolet range is suitable for use within the scope of the present invention. Mention may be made of a mercury vapour lamp in the form a "neon" type tube, a sodium vapour lamp, a luminescent semiconductor element, a light-emitting diode (LED). This device generating ultraviolet radiation makes it possible to regenerate the Fenton reaction catalysts, present in the solution $S_2$ of the reactor. When the treatment installation according to the invention does not comprise such a device generating ultraviolet radiation, it is the plasma that regenerates the Fenton reaction catalysts, present in the solution $S_2$ of the reactor.

The treatment installation according to the present invention may further comprise at least one or a plurality of additional elements such as those described for the installation according to the international application WO 2011/064361. Advantageously, this or these elements are chosen from the group consisting of (i') means devised to apply an electrical current or a given potential to the plasma torch and more particularly to the electrodes forming this plasma torch, (ii') means devised to supply the plasma torch with a plasma-forming gas and optionally a secondary gas, (iii') a condenser, (iv') an air filter, (v') a device for cooling the solution $S_2$, (vi') a device for filtering the solution $S_2$, (vii') means devised to control and adjust the pH of the solution $S_2$ and (viii') means devised to add an acid or a base to the solution $S_2$.

The means devised to supply the plasma torch with a plasma-forming gas and optionally a secondary gas may be any means suitable for conveying a gaseous fluid into a compartment such as gas supply pumps. These means are connected to the plasma torch by piping made of flexible material or rigid material. Furthermore, the means suitable for supplying the plasma torch with at least one plasma-forming gas and optionally with at least one secondary gas may involve channels opening out between the anode and the cathode of the plasma torch and/or channels provided in the anode and/or the cathode.

When the treatment installation according to the present invention is operating, the gases generated following the gasification, combustion and/or oxidation bubble in the solution $S_2$ where they are quenched and purified of the dust thereof and neutralisable chemical species such as HCl, $SO_2$, $SO_3$, $NO_2$, $NO_3$ and $P_2O_5$. Before being discharged outside the device and particularly in the outside environment, they advantageously pass through a condenser and optionally through a filter. As such, the installation according to the present invention may comprise a condenser and optionally an air filter. Advantageously, the condenser and optionally the filter are mounted in the upper part of the reactor.

The condenser which also acts as a demister suitable for use within the scope of the present invention is advantageously a separated fluid condenser wherein a different fluid from the combustion gases and particularly a coolant fluid from a coolant device is kept at a temperature below that of the gas(es) entering the combustion chamber. The condenser suitable for use within the scope of the present invention may be a tubular heat exchanger or evaporator type condenser.

Any type of air filter is suitable for use at the outlet of the condenser within the scope of the present invention. However, in order to ensure high-efficiency filtration, an activated carbon type filter, glass microfibre filter or polytetrafluoroethylene filter can be used. By way of examples, mention may be made of a Megalam® panel filter or a Micretain® air filter.

The operation of the plasma torch and the gasification, combustion and/or oxidation of the components of the solution $S_1$ cause overheating of the solution $S_2$. Consequently, in order to reduce the saturating vapour pressure, the installation according to the present invention may comprise a device for cooling the solution $S_2$ i.e. system suitable for carrying out the cooling of the solution $S_2$. Furthermore, the installation according to the present invention may further comprise a device for filtering the solution $S_2$ i.e. a system suitable for carrying out the filtration of the solution $S_2$.

As such, the installation according to the present invention advantageously comprises an exchanger equipped upstream with a filter. The exchanger suitable for use within the scope of the present invention is a double-flow type heat exchanger wherein the solution $S_2$ exchanges heat with another liquid or gaseous flow so as to keep the temperature of the solution $S_2$ at a level limiting the vapour pressure at the surface of the reactor. This heat exchanger may be an exchanger in the form of a U-shaped tube, a horizontal or vertical tubular exchanger, a coil exchanger or a plate exchanger.

A filter is advantageously placed upstream from the exchanger to retrieve the dust from the combustion and any solid from the precipitation of the minerals present in the solution $S_1$. The filter used within the scope of the device according to the invention comprises at least one membrane advantageously of the nanofiltration, microfiltration or ultrafiltration type. These membranes are defined by pore sizes less than the average particle size of the dust and solids, conventionally from the order of one micrometre to some ten nanometres.

During the treatment, the solution $S_2$ may become acidic or basic according to the circumstances. Also, the device according to the present invention may further comprise means devised to control and adjust the pH of the solution $S_2$.

These means may comprise an electrode for measuring the pH placed in the reactor or in an external circuit to the reactor but connected thereto. The pH may be measured continuously or intermittently. The electrode for measuring the pH is connected, directly or indirectly, to means devised to add an acid or a base to the solution $S_2$.

The present invention further relates to a method for the treatment of a solution $S_1$ as defined above comprising a step consisting of injecting said solution $S_1$ into (i.e. in the core of) a plasma generated using a plasma torch as defined above and submerged in a second liquid solution hereinafter referred to as solution $S_2$ different from solution $S_1$ as defined above.

The term "treatment of a solution $S_1$" denotes within the scope of the present invention reducing the quantity of organic, toxic and/or harmful compounds as defined above and stabilising those which may be corrosive and/or radioactive, these compounds being present in the solution $S_1$ prior to the treatment according to the invention. This reduction may involve removing these compounds and/or converting same into less harmful compounds. Advantageously, at least 70%, at least 80%, at least 90%, at least 95%, at least 96%, at least 97%, at least 98%, at least 99% or even all of the chemical compounds initially contained in the solution $S_1$ are removed and/or converted into less harmful compounds following the treatment according to the invention.

The method according to the present invention advantageously comprises steps consisting of:

a) generating a plasma from a plasma torch equipped with an injection and cooling system as defined above;

b) submerging the plasma generated in step (a) in a solution $S_2$ as defined above;

c) introducing an oxidant gas in the vicinity of the plasma via the second injection device of said injection and cooling system;

d) introducing the solution $S_3$ as defined above in the vicinity of the plasma via the third injection device of said injection and cooling system; and e) introducing the solution $S_1$ as defined above into the plasma submerged in this way via the first injection device of said injection and cooling system.

Typically, steps (a), (b) and (c) are carried out in succession. Steps (c), (d) and (e) may be carried out in succession or simultaneously.

Step (a) of the method according to the invention consists of generating a plasma and particularly a blown arc plasma from a plasma torch as defined above. Advantageously, an electric discharge is produced at the plasma torch consisting of electrodes while a plasma-forming gas passes between these electrodes which generates the plasma.

The plasma-forming gas suitable for use may be any gas known to those skilled in the art. It may vary according to the plasma torch technology used. Within the scope of the present invention, the plasma-forming gas comprises an oxidant gas required for plasma reactivity and/or a neutral gas required for the protection of the cathode of the torch.

In a first alternative embodiment, the plasma-forming gas only comprises one oxidant gas. This alternative embodiment uses a torch not requiring a neutral gas for protection. The oxidant gas may thus be chosen in the group consisting of oxygen, air, carbon dioxide and mixtures thereof. The oxidant gas is advantageously oxygen.

In a second alternative embodiment, the plasma-forming gas comprises an oxidant gas as defined above and a neutral gas. The neutral gas is particularly chosen in the group consisting of argon, helium, nitrogen and mixtures thereof. Advantageously, the plasma obtained in chosen in the group consisting of an argon/oxygen plasma, a helium/oxygen plasma, and a nitrogen/oxygen plasma.

In a third alternative embodiment corresponding particularly to the case where a non-oxidising gasification is sought during step (c) of the method, the plasma functions merely with the neutral gas as defined above and particularly with argon and does not require the addition of oxygen. If oxidation is required to destroy the organic compounds contained in the solution $S_1$, then an oxygen stream may be added in order to produce a neutral gas/oxygen plasma, this oxygen stream being supplied via the second injection device of said injection and cooling system as defined above.

In a fourth alternative embodiment, the plasma-forming gas is an exhaust gas recycled to the plasma torch. Such a gas advantageously comprises the compounds $CO_2/O_2$/Argon. In this alternative embodiment, torch technologies routinely using cooled copper anodes and cathodes may be envisaged. Further metals such as tungsten may be envisaged according to the operating modes chosen. As such, in this fourth embodiment, the plasma used recycles all or part of the gases emitted by the method as plasma-forming gases.

Step (b) of the method according to the present invention consists of filling the reactor wherein the plasma was generated during step (a) with the solution $S_2$. During the filling of the reactor, the latter is not completely filled with the solution $S_2$.

The solution $S_2$, during step (b), has a temperature between 20 and 60° C. and, particularly has a temperature regulated around 30° C.±5° C. Consequently, the relatively high temperature of the reactor following step (a) is lowered, advantageously to the temperature of the solution ($S_2$). Therefore, the term "cold reactor" may be used in the present invention.

Once the plasma has been initiated, the reactor should be filled rapidly to prevent overheating of the system.

Step (c) of the method according to the present invention consists of re-enriching the plasma with oxidant gas. Within the scope of the present invention, this re-enrichment is performed via the second injection device of said injection and cooling system.

The rate of introduction of the oxidant gas will be dependent on the power of the plasma used and the nature of the solution $S_1$. According to the circumstances, it may attain several tens of litres per hour. The introduction of oxidant gas during step (c) may be performed continuously or sequentially by alternating phases with or without the introduction of oxidant gas.

Step (c) of the method according to the present invention may last from a few minutes to several hours or even several days. As such, step (c) of the method according to the present invention may be carried out 24 hours a day for times consistent with the lifetime of the plasma torch.

Step (d) of the method according to the present invention consists of contacting the solution $S_3$ as defined above with the plasma and optionally the combustion gases. Within the scope of the present invention, this contacting is performed via the third injection device of said injection and cooling system.

The rate of introduction of the solution $S_3$ will be dependent on the power of the plasma used and the nature of the solution $S_3$. According to the circumstances, it may attain several tens of litres per hour. The introduction of the solution $S_3$ during step (d) may be performed continuously or sequentially by alternating phases with or without the introduction of solution.

Step (d) of the method according to the present invention may last from a few minutes to several hours or even several days. As such, step (e) of the method according to the present invention may be carried out 24 hours a day for times consistent with the lifetime of the plasma torch.

Step (e) of the method according to the present invention consists of contacting the solution $S_1$ with the plasma core so that the treatment as defined above takes place instantaneously. Within the scope of the present invention, this introduction is performed via the first injection device of said injection and cooling system.

The rate of introduction of the solution $S_1$ will be dependent on the power of the plasma used and the nature of the solution $S_1$. According to the circumstances, it may attain several tens of litres per hour. The introduction of solution $S_1$ during step (e) may be performed continuously or sequentially by alternating phases with or without the introduction of solution.

Step (e) of the method according to the present invention may last from a few minutes to several hours or even several days. As such, step (e) of the method according to the present invention may be carried out 24 hours a day for times consistent with the lifetime of the plasma torch.

As explained above, the gasification, combustion and/or oxidation reaction of the compounds of solution $S_1$ takes place instantaneously in the plasma from the contacting of the solution $S_1$ therewith.

After steps (c), (d) and (e) of the method according to the present invention, the dissociated gases once released from the plasma must be rapidly neutralised and quenched particularly to prevent the formation of toxic complex molecules such as furans or dioxins. The solution $S_2$ carries out these functions. Similarly, the dust and volatile compounds from the gasification, combustion and/or oxidation reaction are respectively removed and condensed by means of the solution $S_2$.

The method according to the present invention comprises an additional step consisting of filtering, cooling and/or neutralising said solution $S_2$. It should be pointed out that the operation of the plasma torch and the reactions occurring during steps (c), (d) and (e) and particularly during step (e) of the method according to the present invention may cause overheating of the solution $S_2$ situated in the reactor.

Also, in order to reduce the saturating vapour pressure, the method according to the present invention may comprise an additional step consisting of cooling the solution $S_2$. This additional step may take place during or after any one of steps (c), (d) and (e) of the method. Advantageously, the cooling of the solution $S_2$ is implemented simultaneously with step (c) of the method. Alternatively, the cooling of the solution $S_2$ is implemented simultaneously with step (e) of the method.

Any system suitable for lowering the temperature of a liquid is suitable for use for this cooling step. Advantageously, this step uses a parallel treatment loop involving an exchanger or a cooling tower.

A filter blocking the mineral particles from the treatment and destruction of the solution $S_1$ is advantageously fitted on the loop, upstream from the exchanger used to cool the solution $S_2$.

Finally, when the treatment method according to the present invention is completed, the reactor is drained of the solution $S_2$ thus allowing the plasma to emerge for a brief time, the time required to dry the parts topping the torch in order to prevent the solution $S_2$ from entering the nozzle thereof. This emergence time produces normal overheating of the reactor. The time during which the plasma is emerged should be quick but sufficient to dry the parts topping the torch. It may be between 10 sec and 5 min.

Once the torch has been switched off, the plasma-forming gas supply should be maintained in order to dry the torch completely. This supply may be maintained for a time greater than 10 min.

Further features and advantages of the present invention will emerge for those skilled in the art on reading the examples hereinafter given by way of illustration and not restriction, with reference to the appended figures.

BRIEF DESCRIPTION OF THE FIGURES

FIG. 3 relates to the first injection device of the injection and cooling system according to the present invention. FIG. 3A is a longitudinal sectional partial schematic view of the first injection device of the injection and cooling system arranged on the plasma torch. FIG. 3B is a perspective partial schematic view of the first injection device of the injection and cooling system.

FIG. 4 relates to the second injection device of the injection and cooling system according to the present invention. FIG. 4A is a longitudinal sectional partial schematic view of the first and second injection devices of the injection and cooling system arranged on the plasma torch. FIG. 4B is a perspective partial schematic view of the second injection device of the injection and cooling system.

FIG. 5 relates to the third injection device of the injection and cooling system according to the present invention.

FIG. 6 relates to the cooling device of the injection and cooling system according to the present invention.

DETAILED DESCRIPTION OF PARTICULAR EMBODIMENTS

I. Device

Hereinafter, the terms "axial" and "radial" are defined with respect to the axis of the plasma torch AA'.

Figure 1:
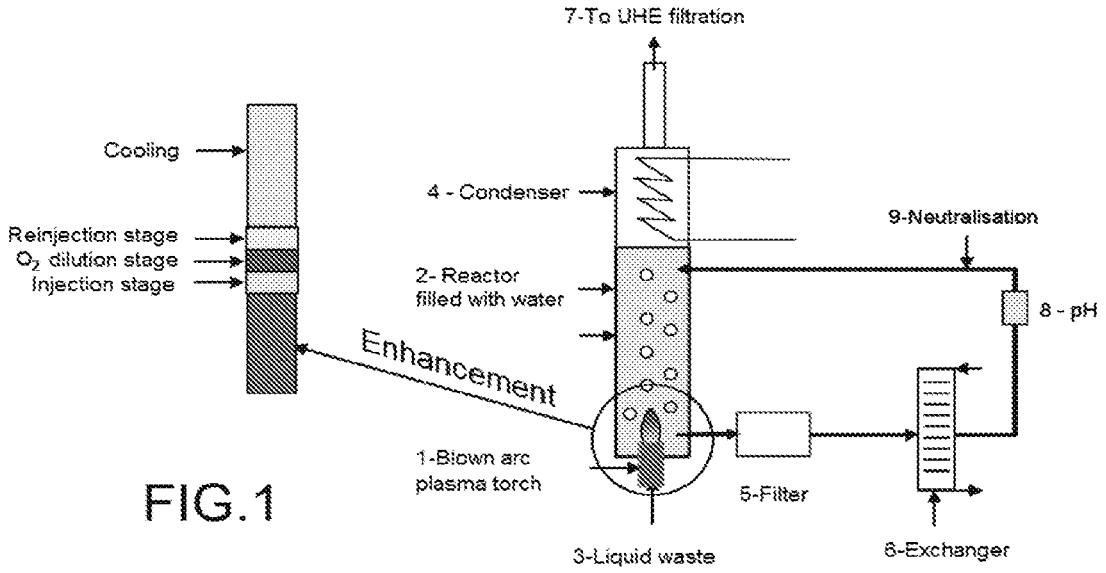
FIG. 1 is a general and schematic view of a waste treatment device according to the international application WO 2011/064361 and according to the present invention with, as an insert, the schematic representation of the injection and cooling system according to the present invention.

FIG. 1 illustrates in the right-hand section thereof the operating principle of the method as described in the international application WO 2011/064361 [5] and as implemented in the present invention.

FIG. 1 illustrates the description provided hereinafter. The present invention is based on the use of a blown arc plasma 1 submerged in a reactor of cylindrical shape and having a volume of 50 L, filled with water 2. The liquid product to be treated 3 such as a mixture of tributyl phosphate (TBP) and dodecane is introduced into the plasma via the first injection device of the injection and cooling system according to the invention. Once in the plasma, the liquid is instantaneously brought to a very high temperature of the order of 2000° C. in the presence of oxygen, resulting in the total destruction of the organic matter.

Figure 2:
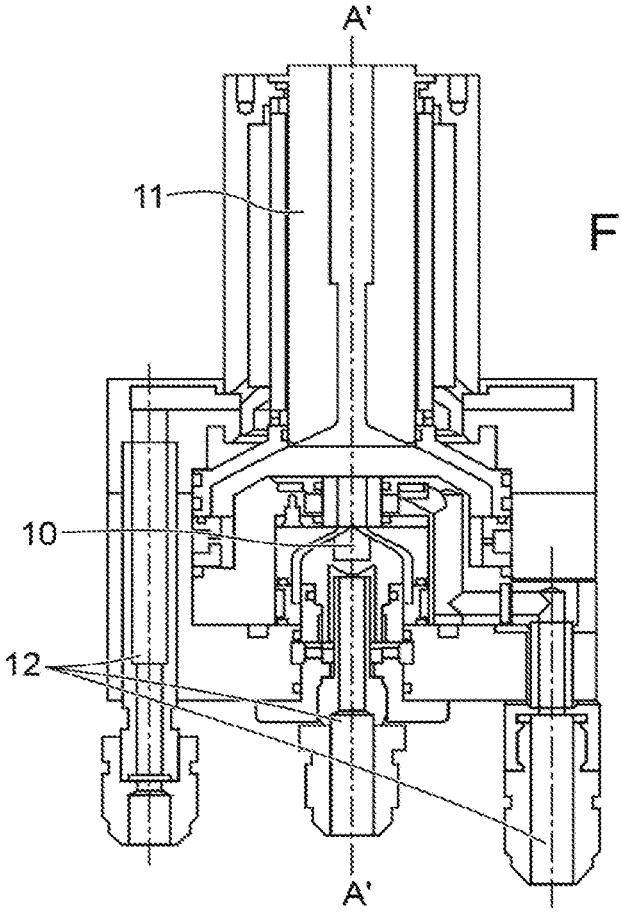
FIG. 2 is a more detailed view of a blown arc plasma torch suitable for being used in a device for the treatment of liquid waste according to the present invention.

FIG. 2 represents the plasma torch used. It consists of a conventional plasma torch wherein a refractory metal cathode 10 particularly made of tungsten, of conical shape, protected by an argon stream generates an electric arc to an anode 11. The anode 11 is presented in the form of a copper sheath 10 cm in length and 10 mm in diameter. This arc is blown by an argon and oxygen stream. The plasma torch used has a device 12 for cooling by internal water circulation the diaphragm and the anode.

FIGS. 3A and 3B represent the first injection device 13 of the injection and cooling system according to the invention. This first device is placed at the outlet of the plasma torch and particularly in the vicinity of the anode 11. More particularly, this first device is presented in the form of a cooled metal part made of Inconel® measuring 26 mm in height, cylindrical with a circular cross-section and having a central recess 14 of cylindrical shape with a circular cross-section. This central recess 14 forms part of the cavity of the injection and cooling system. This first device has an attachment flange 15 projecting radially outwards having at least one orifice 16 for the passage of a tie rod. Advantageously, the attachment flange has four orifices 16 for the passage of tie rods. This first device 13 has a circulation chamber 17 of the liquid to be treated, at least one intake channel 18 of the liquid to be treated leading to said circulation chamber 17 and at least one injection channel 19 of the liquid to be treated connected to said circulation chamber 17 and leading to the central recess 14 i.e. in the cavity of the injection and cooling system. The intake channel 18 of the liquid to be treated leads via at least one orifice 20 to the side wall of the first injection device 13. The injection channel 19 is oriented towards to the outlet orifice of the plasma 21. The liquid to be treated is injected at a rate of a few centimeters per second, this rate varying according to an adjustable flow rate between 0 and 4 litres per hour.

FIGS. 4A and 4B represent the second injection device 22 of the injection and cooling system according to the invention. This second device 22 is placed on and in contact with the first injection device 13. More particularly, this second device 22 is presented in the form of a metal part made of Inconel®, measuring 22 mm in height, cylindrical with a circular cross-section and having a central recess 23. The walls defining the central recess 23 have an internal radial surface of tapered shape. In fact, this second device 22 acts as a divergent at the nozzle outlet. This second device 22 has an oxidant gas circulation chamber 24, at least one oxidant gas intake channel 25 leading to said circulation chamber 24 and at least one oxidant gas injection channel 26 connected to said circulation chamber 24 and leading to the central recess 23 i.e. in the cavity of the injection and cooling system. The oxidant gas intake channel 25 leads via at least one orifice 27 to the side wall of the second injection device 22. The injection channel 26 of a few mm in diameter is oriented towards the third injection device 28. The second injection device has at least one orifice 29 for the passage of a tie rod. Advantageously, it has four orifices 29 for the passage of tie rods.

Figures 5A, 5B:
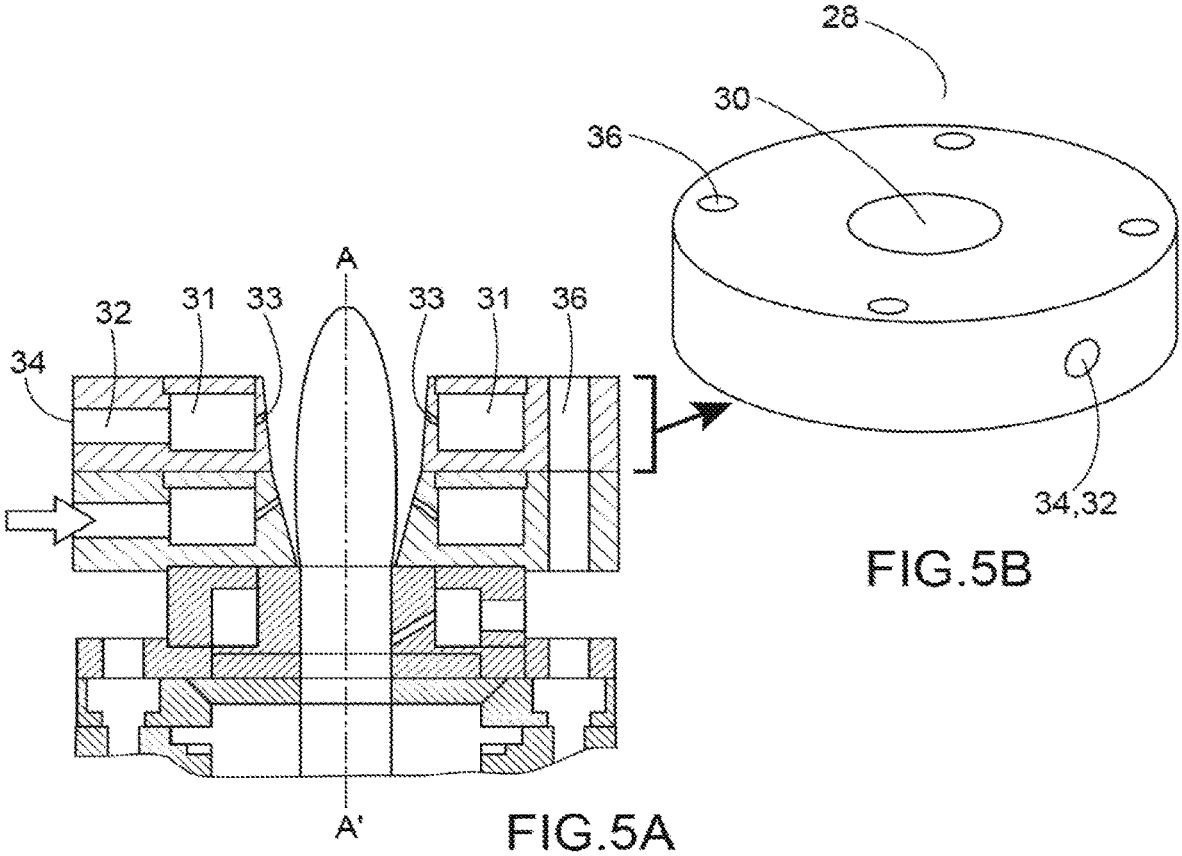
FIG. 5A is a longitudinal sectional partial schematic view of the first, second and third injection devices of the injection and cooling system arranged on the plasma torch.
FIG. 5B is a perspective partial schematic view of the third injection device of the injection and cooling system.

FIGS. 5A and 5B represent the third injection device 28 of the injection and cooling system according to the invention. This third device 28 is placed on and in contact with the second injection device 22. More particularly, this third device 28 is presented in the form of a metal part made of stainless steel, measuring 22 mm in height, cylindrical with a circular cross-section and having a central recess 30 of cylindrical shape with a circular cross-section and having a central recess 30. The walls defining the central recess 30 have an internal radial surface of tapered shape. This third device 28 has a circulation chamber 31 of the solution $S_3$ as defined above and particularly water, at least one intake channel 32 of the solution $S_3$ and particularly water leading to said circulation chamber 31 and at least one injection channel 33 of the solution $S_3$ and particularly water connected to said circulation chamber 31 and leading to the central recess 30 i.e. in the cavity of the injection and cooling system. The intake channel 32 of the solution $S_3$ and particularly water leads via at least one orifice 34 to the side wall of the third injection device 28. The injection channel 33 is oriented towards the cooling device 35. The third injection device has at least one orifice 36 for the passage of a tie rod. Advantageously, it has four orifices 36 for the passage of tie rods.

Figures 6A, 6B:
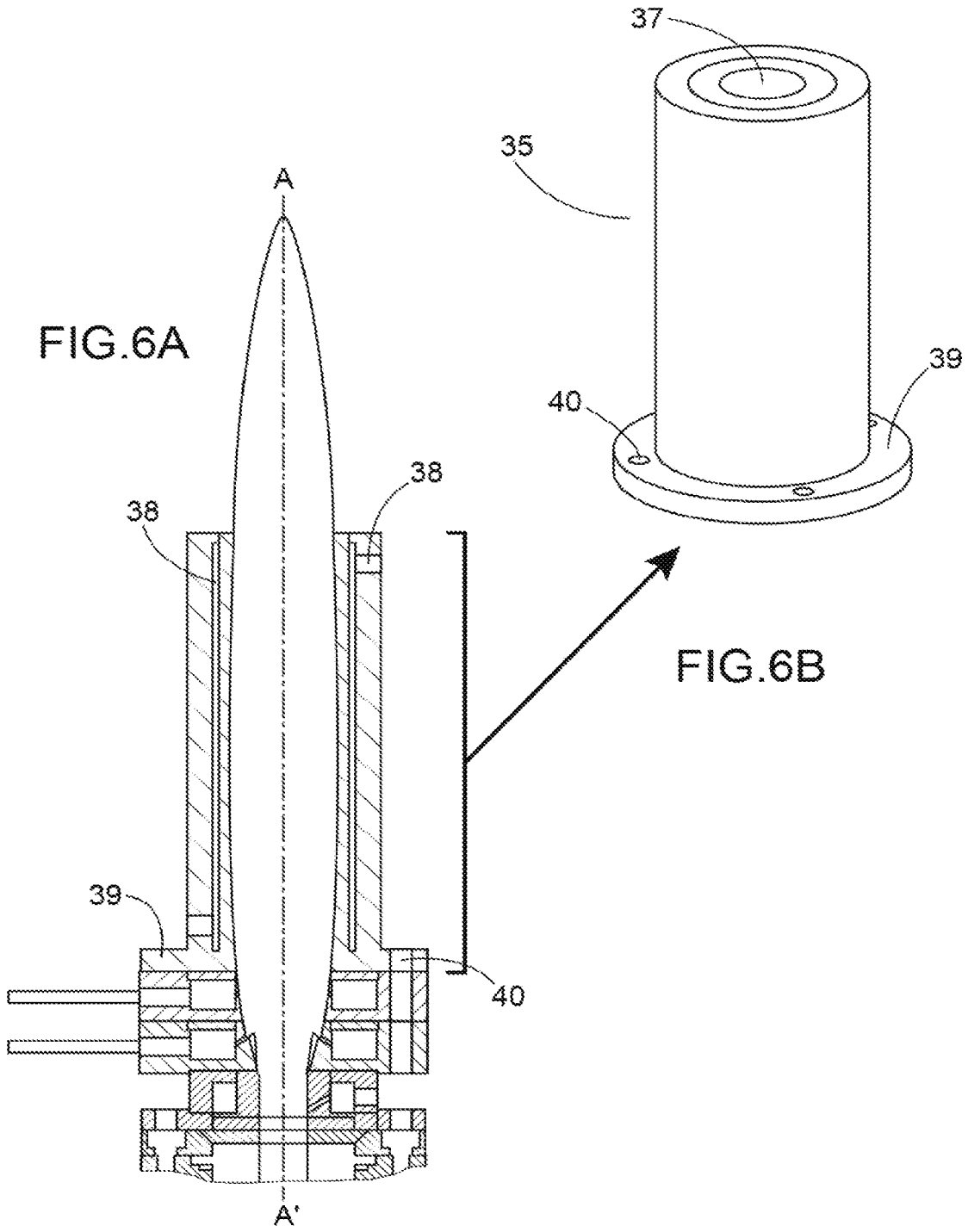
FIG. 6A is a longitudinal sectional partial schematic view of the first, second and third injection devices and the cooling device of the injection and cooling system arranged on the plasma torch.
FIG. 6B is a perspective partial schematic view of the cooling device of the injection and cooling system.

FIGS. 6A and 6B represent the cooling device 35 of the injection and cooling system according to the invention. This cooling device 35 is presented in the form of a metal part made of stainless steel, measuring 107 mm in height, having the shape of a shaft (or sheath or nozzle) and having a central recess in the form of a shaft (or sheath or nozzle) wherein the internal walls define a cylindrical central recess 37 having a circular cross-section. In the wall thereof, the cooling device 35 has a channel 38 or a plurality of channels for circulating a coolant such as water. This cooling device 35 has an attachment flange 39 projecting radially outwards having at least one orifice 40 for the passage of a tie rod. Advantageously, the attachment flange has four orifices 40 for the passage of tie rods.

The injection and cooling system according to the invention has at least one tie rod or bolt which jointly provides the attachment and fastening of the devices 13, 22, 28 and 35 to one another and with the plasma torch. These tie rods pass through the orifices 16, 27, 34 and 40.

The treatment method using a blown arc plasma 1 obtained from a plasma torch equipped with an injection and cooling system submerged in a reactor filled with an aqueous solution 2. This aqueous solution may further contain in solubilised form metal ions and hydrogen peroxide in order to carry out a Fenton reaction maintained by the UV radiation from the plasma torch.

After instantaneous gasification and decomposition in the argon-oxygen plasma plume, the residual or partially oxidised organic compounds are subjected to a second oxygen stream introduced via the second injection device 22 of the injection and cooling system according to the invention.

The combustion gases are then quenched with water so that they reach a temperature level suitable for establishing the chemical equilibriums compatible with emission requirements. The addition of water which may also be the aqueous solution of the reactor is carried out by means of the third injection device 28 of the injection and cooling system according to the invention.

The gases then pass though the cooling device 35 of the injection and cooling system according to the invention wherein they finish cooling and adopt the final composition thereof before entering the core of the aqueous solution wherein they are instantaneously quenched.

During bubbling, the gases are purified of the dust thereof and neutralisable chemical species such as HCl, HF, SOx, NOx, $P_2O_5$, etc. They then pass through a condenser 4 which also acts as a demister and are discharged outside. According to purification level sought, the gases may be subjected to ultra-high-efficiency filtration 7 to prevent any particle emissions.

The aqueous solution of the reactor may contain ions suitable for catalysing the optimisation of the degradation of residual compounds at very low levels. For example, ferrous ions $Fe^{2+}$ associated with the presence of hydrogen peroxide may be added so as to catalyse the formation of OH radicals ensuring the destruction of residual organic matter. The $Fe^{3+}/Fe^{2+}$ transition may then be performed by the UV radiation from the arc plasma.

The operation of the plasma torch and the combustion of the organic matter cause overheating of the aqueous solution situated in the reactor. In order to reduce the saturating vapour pressure, the water is cooled in a loop via an exchanger 6. The temperature thereof is maintained at a level limiting the vapour pressure at the reactor surface. The cooling circuit is equipped upstream from the exchanger 6 with a filter 5 retrieving the solids from the precipitation of the minerals present in the effluents to be treated. This filtration-cooling loop extracts the solution into the lower part of the reactor and reintroduces same into the upper part thereof.

During the treatment, the reactor solution may become acidic or basic according to the circumstances. Online monitoring of the pH 8 enables continuous adjustment of the value thereof by adding an acid of a based according to the circumstances 9. This adjustment should, if applicable, account for the chemical requirements imposed by the use of the Fenton reaction.

II. Operation and Performances

The experimental development phases used to design the enhancements described in the present invention clearly illustrate the various enhancement steps.

The tests were conducted on a solution to be treated comprising a mixture of tributyl phosphate (TBP) and dodecane, this mixture having the dual specificity of having a high NCV ($\approx$10 kW·h·L$^{-1}$). This solution was injected into the plasma at a feed rate of 3 L·h$^{-1}$.

The plasma torch operates at a flow rate of 30 NL·min$^{-1}$ of argon and 180 NL·min$^{-1}$ of oxygen in the arrangement represented in FIG. 1.

The measurements made on the composition of the solution show destruction rates greater than 99.5%. The positioning of the various stages at the plasma torch outlet modifies the gas emission composition substantially. The CO and $CO_2$ contents, representative of the level of oxidation of the gas mixture, were monitored in the following four scenarios:

Untreated Injection into Plasma Flame:

CO composition at outlet: 12%

$CO_2$ composition at outlet: 4%

Injection into Plasma Flame Followed by Re-Enrichment with $O_2$ (40 NL·Min$^{-1}$):

CO composition at outlet: 9%

$CO_2$ composition at outlet: 6%

Note herein that adding oxygen provides superior oxidation but also partial cooling of the gas enabling a thermal shift of the $CO/CO_2$ equilibrium.

Injection into Plasma Flame Followed by Re-Enrichment with $O_2$ (40 $NL \cdot Min^{-1}$) and Cooling in Nozzle:

CO composition at outlet: 8%

$CO_2$ composition at outlet: 9%

The cooling provided by the outlet nozzle is not sufficient as the CO level is still well above emission standards.

Injection into Plasma Flame Followed by Re-Enrichment with $O_2$ (40 $NL \cdot Min^{-1}$), Addition of Cooling Water (0.3 $L \cdot Min^{-1}$) and Cooling in Nozzle:

CO composition at outlet: 0.2%

$CO_2$ composition at outlet: 8%

This last test demonstrates the effectiveness of the technological enhancements applied.

REFERENCES

[1] Patent application EP 0,469,737 (Tioxide Group Services Limited) "Destruction process" published on 5 Feb. 1992.

[2] Alekseev N. V., Samokhin A. V., Belivtsev A. N. and Zhavoronkova V. I., (2000) "Thermal-Plasma Jet Oxidation of Phenol in Aqueous Solutions", High Energy Chemistry, Vol. 34, No 6, pp. 389-393.

[3] Fortin L., Soucy G., Kasireddy V., Bernier J.-L., Boulos M. I (1999) "The Use of Thermal Plasma for Wastewater Treatment", 14th International Symposium on Plasma Chemistry—ISPC'14, Prague (Czech Republic), pp. 2387-2392.

[4] International application WO 97/22556 (Alcan International Limited) "Thermal Plasma Reactor and Wastewater Treatment Method" published on 26 Jun. 1997.

[5] International application WO 2011/064361 (CEA) "Method and device for the treatment of waste through injection into an immersed plasma" published on 3 Jun. 2011.

The invention claimed is:

1. An injection and cooling system, configured to equip a plasma torch, including a cavity configured to contain plasma and combustion gas and comprising:

a first injection device configured to inject, into the cavity, a liquid solution $S_1$;

a second injection device arranged adjacent to the first injection device and configured to inject, into the cavity, an oxidant gas;

a cooling device configured to cool gas contained in the cavity; and a third injection device arranged between the second injection device and the cooling device and configured to inject, into the cavity, a liquid solution $S_3$ different than the liquid solution $S_1$, wherein the first injection device, the second injection device, the third injection device, and the cooling device are coaxially aligned and define the cavity, and the system comprises the first injection device, the second injection device, the third injection device, and the cooling device arranged successively in order.

2. The injection and cooling system according to claim 1, wherein the first injection device comprises at least one first channel leading to the cavity and configured to convey the liquid solution $S_1$ therein.

3. The injection and cooling system according to claim 1, wherein the second injection device comprises at least one second channel leading to the cavity and configured to convey the oxidant gas therein.

4. The injection and cooling system according to claim 1, wherein the third injection device comprises at least one third channel leading to the cavity and configured to convey the liquid solution $S_3$ therein.

5. The injection and cooling system according to claim 1, wherein the cooling device comprises at least one sheath cooled by internal water circulation.

6. A plasma torch comprising the injection and cooling system according to claim 1.

7. An installation for treatment of a liquid solution $S_1$ comprising:

a plasma torch comprising the injection and cooling system according to claim 1;

a container of the liquid solution $S_t$;

first means configured to convey the liquid solution $S_1$ from the container of the liquid solution $S_1$ to the first injection device of the injection and cooling system;

a container of the oxidant gas;

second means configured to convey the oxidant gas from the container of the oxidant gas to the second injection device of the injection and cooling system;

a container of the liquid solution $S_3$; and third means comprised to convey the liquid solution $S_3$ from the container of the liquid solution $S_3$ to the third injection device of the injection and cooling system.

8. The installation according to claim 7, wherein the container of the liquid solution $S_3$ is a reactor containing a solution $S_2$ different than the liquid solution $S_1$ to be treated.

9. The installation according to claim 7, wherein the installation further comprises a reactor containing a solution $S_2$ different than the liquid solution $S_1$.

10. The installation according to claim 7, wherein the installation further comprises a device generating ultraviolet radiation.

11. The installation according to claim 9, wherein the installation further comprises at least one element from the group consisting of (i) means configured to apply an electrical current or a given potential to the plasma torch and to electrodes forming the plasma torch, (ii) means configured to supply the plasma torch with a plasma-forming gas, (iii) a condenser, (iv) an air filter, (v) a device for cooling the solution $S_2$, (vi) a device for filtering the solution $S_2$, (vii) means configured to control and adjust pH of the solution $S_2$ and (viii) means configured to add an acid or a base to the solution $S_2$.

12. A method for treatment of the liquid solution $S_1$ comprising injecting the liquid solution $S_1$ into a plasma generated using the plasma torch according to claim 6 and submerged in a solution $S_2$ different from the liquid solution $S_1$.

13. The method according to claim 12, comprising:

a) generating a plasma from the plasma torch equipped with the injection and cooling system;

c) introducing the oxidant gas in a vicinity of the plasma via the second injection device of the injection and cooling system;

d) introducing the liquid solution $S_3$ in the vicinity of the plasma via the third injection device of the injection and cooling system; and e) introducing the liquid solution $S_1$ into the plasma via the first injection device of the injection and cooling system.

* * * * *